United States Patent [19]

Yamazaki

[11] Patent Number: 4,623,818

[45] Date of Patent: Nov. 18, 1986

[54] SHADOW MASK TYPE COLOR PICTURE TUBE

[75] Inventor: Eiichi Yamazaki, Ichihara, Japan

[73] Assignee: Hitachi, Ltd., Tokyo, Japan

[21] Appl. No.: 682,182

[22] Filed: Dec. 17, 1984

[30] Foreign Application Priority Data

Dec. 23, 1983 [JP] Japan ..... 58-241951

[51] Int. Cl.[4] ..... H01J 29/07; H01J 29/86

[52] U.S. Cl. ..... 313/408; 313/477 R

[58] Field of Search ..... 313/402–405, 313/407, 408, 477 R

[56] References Cited

U.S. PATENT DOCUMENTS 2,690,518 9/1954 Fyler et al. ..... 313/408 X 3,705,322 12/1972 Naruse et al. ..... 313/408

FOREIGN PATENT DOCUMENTS 1358161 7/1974 United Kingdom ..... 313/477

*Primary Examiner*—Palmer C. DeMeo

*Assistant Examiner*—Sandra L. O'Shea

*Attorney, Agent, or Firm*—Charles E. Pfund

[57] ABSTRACT

In a shadow mask type color picture tube, the radius of curvature of the peripheral portion of the inner surface of a faceplate on which a phosphor screen is formed is set to be smaller than that at the central portion thereof.

4 Claims, 2 Drawing Figures

SHADOW MASK TYPE COLOR PICTURE TUBE

BACKGROUND OF THE INVENTION

The present invention relates to a shadow mask type color picture tube.

It is generally well known that a shadow mask of a shadow mask type color picture tube is locally expanded due to its thermal expansion, and a landing error of electrons passing therethrough occurs. Such local expansion of the shadow mask is called doming. The doming phenomenon typically occurs when the shadow mask becomes flat. When the shadow mask has a smaller radius of curvature, doming is reduced. Various countermeasures have been conventionally implemented to reduce doming. For example, the aperture pitch in a shadow mask is increased from the central portion toward the periphery. By adapting such a variable pitch technique, the radius of curvature of the shadow mask as a whole is decreased to reduce the doming phenomenon. In this conventional structure, however, since the shadow mask as a whole is fabricated in accordance with the variable pitch technique, an image at the peripheral portion of the screen has a poor resolution when a difference between the pitch of the central and peripheral apertures becomes large. For this reason, an increase in the pitch of the peripheral apertures is limited within an allowable image quality.

In addition, demand has recently arisen for high-resolution color picture tubes for displaying small characters. In order to meet this demand, the pitch of the apertures in the shadow mask must be decreased. However, when this demand is satisfied, the doming phenomenon cannot be eliminated if only the variable pitch technique is adapted.

Furthermore, there is also a tendency for flattening of the phosphor screen of a color picture tube. This tendency conflicts with demand for preventing the doming phenomenon.

SUMMARY OF THE INVENTION

It is, therefore, a principal object of the present invention to provide a shadow mask type color picture tube wherein the doming phenomenon is greatly decreased as compared with a conventional color picture tube of the same type.

It is another object of the present invention to provide a shadow mask type color picture tube wherein the doming phenomenon is sufficiently reduced even if small characters are displayed.

It is still another object of the present invention to provide a shadow mask type color picture tube wherein the doming phenomenon can be reduced as compared with a color picture tube of the same type, and wherein a phosphor screen of the color picture tube can be rendered flat.

In order to achieve the above object of the present invention, the present inventors made studies of conventional solutions to the problem of doming. As a result of such studies, the present inventors found out that conventional solutions have been based on improvement in a shadow mask viewed as a source of the doming phenomenon and have underestimated the influence of a change in structure portion other than the shadow mask, i.e., the change in the surrounding structure portion which is caused upon expansion of the shadow mask. Based on this finding, the present inventors have established the present invention.

According to an aspect of the present invention, there is provided a shadow mask type color picture tube wherein a shadow mask is opposed to a faceplate having a phosphor screen formed on an inner surface thereof, characterized in that a radius of curvature at a peripheral portion of the inner surface thereof is smaller than that at a central portion thereof.

DESCRIPTION OF THE PREFERRED EMBODIMENTS

Figure 1:
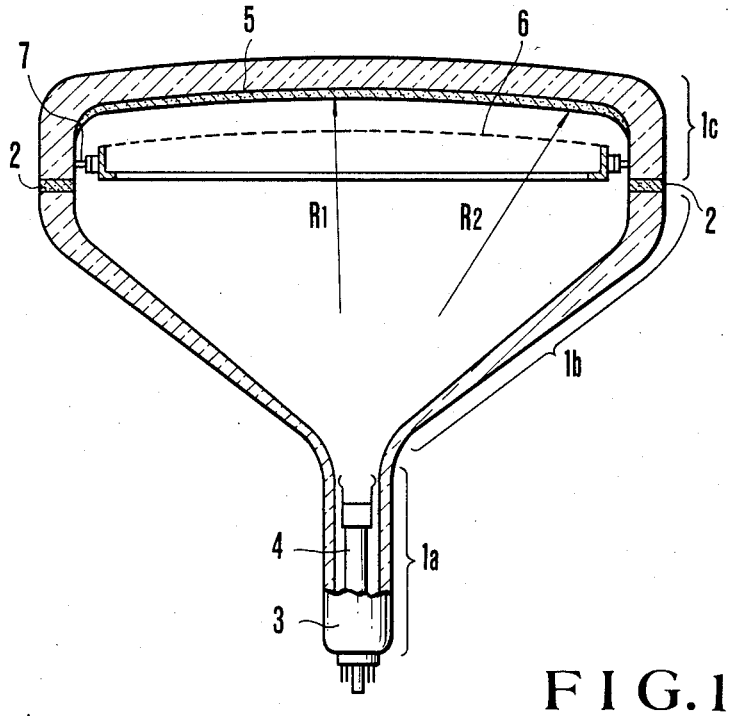
FIG. 1 is a sectional view of a main part of an embodiment of a shadow mask type color picture tube according to the present invention.

FIG. 1 shows an embodiment of a shadow mask type color picture tube according to the present invention. Referring to FIG. 1, a color picture tube 1 has a neck 1*a*, a funnel 1*b*, and a faceplate 1*c* which seals the open end of the funnel 1*b* through frit glass 2. An electron gun assembly 4 mounted on a stem 3 is sealed inside the neck 1*a*. A phosphor screen 5 is formed on the inner surface of the faceplate 1*c*. A shadow mask 6 is opposed to the phosphor screen 5 with a predetermined distance therebetween. The shadow mask 6 is fixed at the inner wall portion of the faceplate 1*c* by a mask support 7 such as a leaf spring.

The inner surface of the faceplate 1*c* as the characteristic feature of the present invention, i.e., the phosphor side surface thereof, has a radius of curvature which is greater at the central portion than that at the peripheral portion. In other words, the inner surface of the faceplate 1*c* has a radius of curvature which decreases from the central portion to the peripheral portion.

Figure 2:
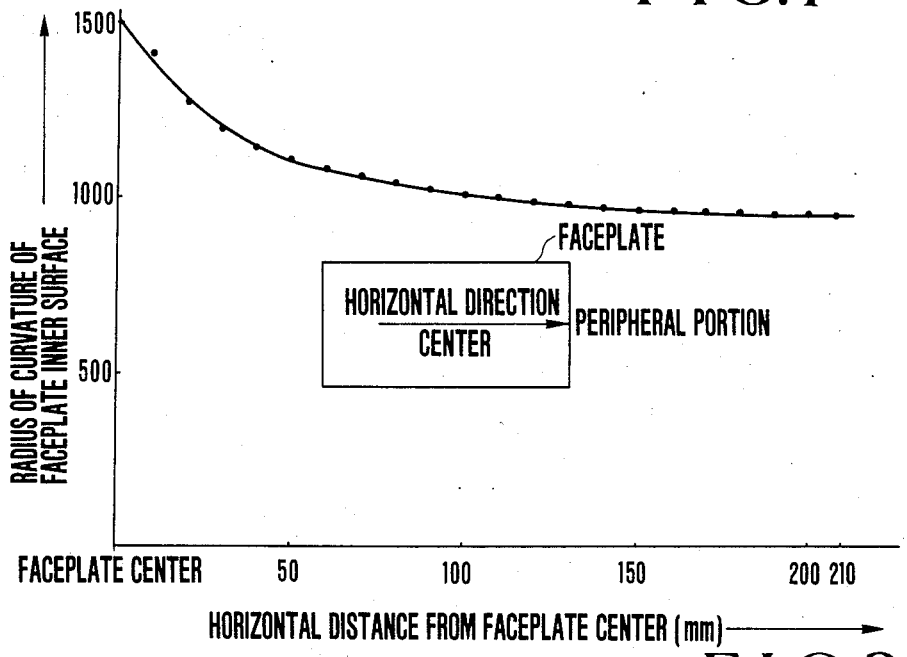
FIG. 2 is a graph showing the radius of curvature which changes from the central portion toward the peripheral portion of the inner surface of a panel portion shown in FIG. 1.

An example of specifications of a 20"-color picture tube is as follows. A radius of curvature R1 at the central portion of the inner surface of the faceplate 1*c* is 1,500 mm. A radius of curvature R2 at the peripheral portion at a distance of about 170 mm from the faceplate center i.e., the peripheral portion of the useful picture area is approximately 950 mm. A radius of curvature at the center of the faceplate 1*c*, i.e., from the central portion to the peripheral portion in the horizontal direction is gradually decreased, as shown in FIG. 2. Thus, an average radius of curvature over the entire inner surface of the faceplate 1*c* is about 1,150 mm.

The landing error generated by doming is known to be proportional to $R^{1.3}$ (where R is the radius of curvature of a corresponding portion). Therefore, when the radius of curvature at the peripheral portion of the inner surface of the faceplate 1*c* is set to be smaller than that at the central portion as in the embodiment described above, and the shadow mask has a radius of curvature which changes in the same manner as the faceplate, the overall faceplate has a doming phenomenon which is smaller by about 22% than that of a conventional picture tube having a faceplate of a fixed radius of curvature. Since the doming phenomenon generally occurs more in a portion separated from the center in the horizontal direction rather than in the vertical direction of the faceplate 1*c*, the doming phenomenon can be considerably reduced if the radius of curvature is changed in the manner described above only in the horizontal direction.

When the present invention is implemented, the radius of curvature of a shadow mask arranged at a predetermined distance from the inner surface of the faceplate is defined in accordance with variable aperture pitch or other conditions. Thus, the shadow mask can have various shapes. For example, as in the case of the inner surface of the faceplate, the radius of curvature at the peripheral portion of the shadow mask can be set to be smaller than that of the central portion thereof, and vice versa.

However, in either case, as compared to a case wherein a faceplate having an inner surface of a conventional shape is used, according to the present invention, the radius of curvature of the shadow mask can be decreased at the peripheral portion. Therefore, the effect of the present invention can be obtained in either case. When a shadow mask according to the present invention has a conventional variable pitch structure, the effect of eliminating the doming phenomenon can be further enhanced.

As has been described above, according to the present invention the radius of curvature in both a shadow mask which is generally subject to doming and in an opposing faceplate is set to be smaller at a peripheral portion than that at a central portion. With this relatively simple construction, the doming phenomenon can be reduced as compared to a conventional structure, the phosphor screen can be rendered flat, and smaller characters can be displayed.

What is claimed is:

1. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area said gradual decrease being matched to compensate for the effect of doming in corresponding portions of an adjacent shadow mask.

2. A color picture tube according to claim 1, characterized in that the radius of curvature at the peripheral portion of said faceplate is set to be smaller than that at the central portion thereof along a horizontal direction.

3. A color picture tube according to claim 1, characterized in that a radius of curvature at a peripheral portion of said shadow mask is also set to be smaller than that at a central portion thereof.

4. A color picture tube according to claim 1, characterized in that said shadow mask comprises a variable pitch mask.

* * * * *

US004623818B1

REEXAMINATION CERTIFICATE (4051st)

United States Patent [19] [11] B1 4,623,818

Yamazaki [45] Certificate Issued Apr. 25, 2000

[54] SHADOW MASK TYPE COLOR PICTURE TUBE

[75] Inventor: Eiichi Yamazaki, Ichihara, Japan

[73] Assignee: Hitachi, Ltd., Tokyo, Japan

Reexamination Request:
No. 90/004,755, Sep. 19, 1997

Reexamination Certificate for:

| | |
|---|---|
| Patent No.: | **4,623,818** |
| Issued: | **Nov. 18, 1986** |
| Appl. No.: | **06/682,182** |
| Filed: | **Dec. 17, 1984** |

[30] Foreign Application Priority Data

Dec. 23, 1983 [JP] Japan ..... 58-241951

[51] Int. Cl.[7] ..... H01J 29/07; H01J 29/86

[52] U.S. Cl. ..... 313/408; 313/477 R

[58] Field of Search ..... 313/402, 403, 313/404, 405, 407, 408, 477 R

[56] References Cited

U.S. PATENT DOCUMENTS

| | | |
|---|---|---|
| Re. 27,259 | 12/1971 | Rublack . |
| 2,728,012 | 12/1955 | Swedlund . |
| 3,435,268 | 3/1969 | Rublack . |
| 3,931,906 | 1/1976 | Bradu . |
| 4,056,755 | 11/1977 | Sohn . |
| 4,136,300 | 1/1979 | Morrell . |
| 4,537,321 | 8/1985 | Tokita . |
| 4,537,322 | 8/1985 | Okada et al. . |
| 4,786,840 | 11/1988 | Ragland, Jr. . |
| 4,839,556 | 6/1989 | Ragland, Jr. . |
| 4,887,001 | 12/1989 | D'Amato et al. . |

FOREIGN PATENT DOCUMENTS

| | | |
|---|---|---|
| 0081366 | 12/1982 | European Pat. Off. . |
| 0146926 | 4/1988 | European Pat. Off. . |
| 51-47365 | 4/1976 | Japan . |
| 53-35366 | 4/1978 | Japan . |
| 55-28269 | 2/1980 | Japan . |
| 55-28270 | 2/1980 | Japan . |
| 57-103239 | 6/1982 | Japan . |
| 868882 | 9/1978 | Russian Federation . |
| 1130206 | 10/1968 | United Kingdom . |
| 1358161 | 6/1970 | United Kingdom . |
| 1358161 | 6/1974 | United Kingdom . |
| 2136198 | 9/1984 | United Kingdom . |

OTHER PUBLICATIONS

A.M. Morrell, "Color Picture Tube Design Trends", 2320 Proceedings of the Society for Information Display, vol. 22, Los Angeles, CA, USA, Dec. 1981.

*Primary Examiner*—Ashok Patel

[57] ABSTRACT

In a shadow mask type color picture tube, the radius of curvature of the peripheral portion of the inner surface of a faceplate on which a phosphor screen is formed is set to be smaller than that at the central portion thereof.

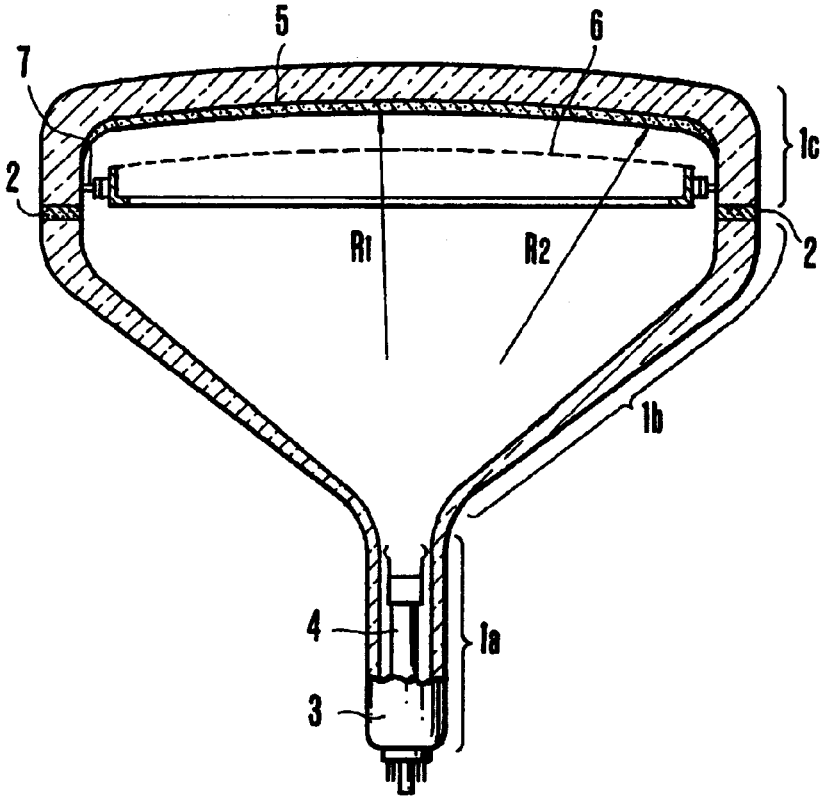

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claim 1 is determined to be patentable as amended.

Claims 2–4, dependent on an amended claim, are determined to be patentable.

New claims 5–22 are added and determined to be patentable.

1. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area *such that the inner surface of said faceplate has a radius of curvature of approximately 63% or less at a position 170 mm or more apart from the center of the faceplate compared to a radius of curvature at the center of the faceplate,* said gradual decrease being matched to compensate for the effect of doming in corresponding portions of an adjacent shadow mask.

*5. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area and in that the radius of curvature of the shadow mask is set to gradually decrease from the central portion thereof toward the peripheral portion of the useful picture area such that the shadow mask has a radius of curvature of approximately 63% or less at a position 170 mm or more apart from the center of the shadow mask compared to a radius of curvature at the center of the shadow mask, said gradual decrease being matched to compensate for the effect of doming in corresponding portions of the shadow mask.*

*6. A color picture tube according to claim 5, characterized in that the radius of curvature at the peripheral portion of said shadow mask is set to be smaller than that at the central portion thereof along a horizontal direction.*

*7. A color picture tube according to claim 5, characterized in that said shadow mask comprises a variable pitch mask.*

*8. A shadow mask type color picture tube wherein a shadow mask is opposed to an inner surface of a faceplate on which a phosphor screen is formed, characterized in that the radius of curvature of the inner surface of said faceplate and the radius of curvature of the shadow mask are both set to gradually decrease from the central portion thereof toward the peripheral portion of the useful picture area such that the inner surface of said faceplate has a radius of curvature of approximately 63% or less at a position 170 mm or more apart from the center of the faceplate compared to a radius of curvature at the center of the faceplate, and the shadow mask has a radius of curvature of approximately 63% or less at a position 170 mm or more apart from the center of the shadow mask compared to a radius of curvature at the center of the shadow mask, said gradual decrease in the faceplate and the shadow mask being matched to compensate for the effect of doming in corresponding portions of the shadow mask.*

*9. A color picture tube according to claim 8, characterized in that the radius of curvature of said inner surface of said faceplate and of said shadow mask are taken along and compared along a horizontal direction.*

*10. A color picture tube according to claim 8, characterized in that said shadow mask comprises a variable pitch mask.*

*11. A shadow mask type color picture tube according to claim 1, further characterized in that said shadow mask is convex in its entire perforated effective area opposite to said inner surface of said faceplate.*

*12. A shadow mask type color picture tube according to claim 5, further characterized in that said shadow mask is convex in its entire perforated effective area opposite to said inner surface of said faceplate.*

*13. A shadow mask type color picture tube according to claim 8, further characterized in that said shadow mask is convex in its entire perforated effective area opposite to said inner surface of said faceplate.*

*14. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area such that the inner surface of said faceplate has a radius of curvature of approximately 63% at a position 170 mm apart from the center of the faceplate compared to a radius of curvature at the center of the faceplate, said gradual decrease being matched to compensate for the effect of doming in corresponding portions of an adjacent shadow mask.*

*15. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area and in that the radius of curvature of the shadow mask is set to gradually decrease from the central portion thereof toward the peripheral portion of the useful picture area such that the shadow mask has a radius of curvature of approximately 63% at a position 170 mm apart from the center of the shadow mask compared to a radius of curvature at the center of the shadow mask, said gradual decrease being matched to compensate for the effect of doming in corresponding portions of the shadow mask.*

*16. A shadow mask type color picture tube wherein a shadow mask is opposed to an inner surface of a faceplate on which a phosphor screen is formed, characterized in that the radius of curvature of the inner surface of said faceplate and the radius of curvature of the shadow mask are both set to gradually decrease from the central portion thereof toward the peripheral portion of the useful picture area such that the inner surface of said faceplate has a radius of curvature of approximately 63% at a position 170 mm apart from the center of the faceplate compared to a radius of curvature at the center of the faceplate, and the shadow mask has a radius of curvature of approximately 63% at a position 170 mm apart from the center of the shadow mask*

*compared to a radius of curvature at the center of the shadow mask, said gradual decrease in the faceplate and the shadow mask being matched to compensate for the effect of doming in corresponding portions of the shadow mask.*

*17. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area such that the inner surface of said faceplate has a radius of curvature of approximately 63% or less at a position 170 mm apart from the center of the faceplate compared to a radius of curvature at the center of the faceplate, said gradual decrease being matched to compensate for the effect of doming in corresponding portions of an adjacent shadow mask.*

*18. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area and in that the radius of curvature of the shadow mask is set to gradually decrease from the central portion thereof toward the peripheral portion of the useful picture area such that the shadow mask has a radius of curvature of approximately 63% or less at a position 170 mm apart from the center of the shadow mask compared to a radius of curvature at the center of the shadow mask, said gradual decrease being matched to compensate for the effect of doming in corresponding portions of the shadow mask.*

*19. A shadow mask type color picture tube wherein a shadow mask is opposed to an inner surface of a faceplate on which a phosphor screen is formed, characterized in that the radius of curvature of the inner surface of said faceplate and the radius of curvature of the shadow mask are both set to gradually decrease from the central portion thereof toward the peripheral portion of the useful picture area such that the inner surface of said faceplate has a radius of curvature of approximately 63% or less at a position 170 mm apart from the center of the faceplate compared to a radius of curvature at the center of the faceplate, and the shadow mask has a radius of curvature of approximately 63% or less at a position 170 mm apart from the center of the shadow mask compared to a radius of curvature at the center of the shadow mask, said gradual decrease in the faceplate and the shadow mask being matched to compensate for the effect of doming in corresponding portions of the shadow mask.*

*20. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area such that the inner surface of said faceplate has a radius of curvature of approximately 63% at a position 170 mm or more apart from the center of the faceplate compared to a radius of curvature at the center of the faceplate, said gradual decrease being matched to compensate for the effect of doming in corresponding portions of an adjacent shadow mask.*

*21. A shadow mask type color picture tube wherein a shadow mask is opposed to an inner surface of a faceplate on which a phosphor screen is formed, characterized in that the radius of curvature of the inner surface of said faceplate is set to gradually decrease from the central portion thereof toward the peripheral portion of the useful picture area and in that the radius of curvature of the shadow mask is set to gradually decrease from the central portion thereof toward the peripheral portion of the useful picture area such that the shadow mask has a radius of curvature of approximately 63% at a position 170 mm or more apart from the center of the shadow mask compared to a radius of curvature at the center of the shadow mask, said gradual decrease being matched to compensate for the effect of doming in corresponding portions of the shadow mask.*

*22. A shadow mask type color picture tube wherein a shadow mask is opposed to an inner surface of a faceplate on which a phosphor screen is formed, characterized in that the radius of curvature of the inner surface of said faceplate and the radius of curvature of the shadow mask are both set to gradually decrease from the central portion thereof toward the peripheral portion of the useful picture area such that the inner surface of said faceplate has a radius of curvature of approximately 63% at a position 170 mm or more apart from the center of the faceplate compared to a radius of curvature at the center of the faceplate, and the shadow mask has a radius of curvature of approximately 63% at a position 170 mm or more apart from the center of the shadow mask compared to a radius of curvature at the center of the shadow mask, said gradual decrease in the faceplate and the shadow mask being matched to compensate for the effect of doming in corresponding portions of the shadow mask.*

* * * * *